US008209887B2

(12) United States Patent
Ghosh

(10) Patent No.: US 8,209,887 B2
(45) Date of Patent: Jul. 3, 2012

(54) WEAR RESISTANT SUPPORT STRUCTURES FOR UTILITY EQUIPMENT

(76) Inventor: Syamal Kumar Ghosh, Rochester, NY (US)

( * ) Notice: Subject to any disclaimer, the term of this patent is extended or adjusted under 35 U.S.C. 154(b) by 57 days.

(21) Appl. No.: 12/802,654

(22) Filed: Jun. 12, 2010

(65) Prior Publication Data

US 2010/0319224 A1 Dec. 23, 2010

Related U.S. Application Data

(60) Provisional application No. 61/268,882, filed on Jun. 17, 2009.

(51) Int. Cl.
*E02F 3/00* (2006.01)

(52) U.S. Cl. ..... 37/270; 37/460

(58) Field of Classification Search ..... 37/260–271, 37/232, 233, 446, 460, 465, 903; 172/701.1–701.3; 407/113, 118, 119, 107, 66
See application file for complete search history.

(56) References Cited

U.S. PATENT DOCUMENTS 2,202,309 A * 5/1940 Campbell ..... 280/28
4,346,528 A 8/1982 Shwayder
4,500,766 A * 2/1985 Reinhardt ..... 219/76.1
4,590,694 A 5/1986 Block
4,607,781 A * 8/1986 Shwayder ..... 228/175
4,756,102 A 7/1988 Chapman
4,899,472 A 2/1990 Winter
5,081,774 A * 1/1992 Kuwano ..... 37/460
5,336,282 A 8/1994 Ghosh et al.
5,375,350 A * 12/1994 Maybon ..... 37/460
5,411,690 A 5/1995 Ghosh et al.
5,427,186 A 6/1995 Adrian et al.
5,435,234 A * 7/1995 Bentz et al. ..... 92/248
5,520,601 A 5/1996 Ghosh et al.
5,881,480 A * 3/1999 Fall ..... 37/460
6,017,172 A * 1/2000 Ukegawa et al. ..... 407/113
6,601,789 B1 * 8/2003 Bajadali et al. ..... 241/301
7,143,531 B2 12/2006 Micozzi
7,322,776 B2 * 1/2008 Webb et al. ..... 407/113
7,407,523 B2 * 8/2008 Brandt ..... 51/293
7,631,441 B2 12/2009 Hunt
7,836,615 B2 * 11/2010 Winter ..... 37/270
7,874,085 B1 * 1/2011 Winter et al. ..... 37/270
2003/0221338 A1 12/2003 Verseef
2008/0263907 A1 10/2008 Winter
2009/0071042 A1 3/2009 Diehl et al.
2009/0320332 A1 12/2009 Thomas

* cited by examiner

*Primary Examiner* — Robert Pezzuto
(74) *Attorney, Agent, or Firm* — Lynne M. Blank

(57) ABSTRACT

The present invention relates to a wear shoe for use with utility equipment comprising a unitary housing having therein at least one cavity containing a wear resistant insert bound within the unitary housing and methods for making the same. Most preferably, the wear resistant insert is a ceramic material.

16 Claims, 3 Drawing Sheets

WEAR RESISTANT SUPPORT STRUCTURES FOR UTILITY EQUIPMENT

CROSS REFERENCE TO RELATED APPLICATIONS

This application claims priority from Provisional Application No. 61/268,882, filed Jun. 17, 2009, entitled "WEAR RESISTANT SUPPORT STRUCTURES WITH CERAMIC INSERTS FOR UTILITY EQUIPMENT", the content of which are incorporated herein in its entirety.

FIELD OF THE INVENTION

The present invention relates to an improved wear pad for supporting heavy duty accessories and support structures for utility equipment, most preferably, for use with street sweepers, snow plows, snow blowers and the like.

BACKGROUND OF THE INVENTION

In the colder climates of North America and other parts of the world, snow plows are required for plowing large areas, such as local roads, highways, parking lots, airports, and commercial and residential driveways.

In order for the snow removal equipment, such as pick up trucks or heavy-duty snow plowing machines, to run efficiently at relatively high speed, the plows must scrape the road surface to remove the accumulated snow and ice. During such operations, the plows and sometimes the vehicles can be heavily damaged if the plow strikes a rigid transverse road projection.

Snow plow shoes or supports have been developed as a sacrificial member to bear most of the loads and impacts resulting from the snow plowing operation. The shoes are installed slightly beneath the bottom surface of the plow to raise the height of the plow above the ground level so that potholes, ice mounds, and other obstacles do not impact the plow directly and cause expensive or irreparable damages. Extreme and frequent wear of support structures and wear pads or shoes equipped for use with street sweepers, snow plows, snow blowers and other such utility vehicles is a costly and time consuming maintenance problem, requiring intensive labor and frequent downtime. Many design changes and various materials have been tried to minimize the frequency of maintenance, resulting in minimal improvement.

Snow plow shoes are generally made from cast iron or steel and the blades are made from forged or hot rolled steel plates. Shoes and blades made from plain carbon or alloy steel may wear out after a relatively short time. The rugged and continuous use of snow plows for hours at a time in removing snow from paved and un-paved road surfaces makes it difficult for the cast iron or steel shoes and blades to last for at least one season. Generally speaking, shoes are replaced a few times a season, depending on the usage. Snow plow shoes are especially prone to wear out faster, because they bear a large portion of the load from the snow plow. Snow plow shoes and blades must withstand large stresses and repeated jarring action. Even relatively smooth layers of snow, ice or even exposed ground can be highly abrasive under certain conditions. Also the steel products are prone to corrosion. Salt and snow (moisture) make the steel components more prone to corrosion, resulting in fretting wear, in addition to regular wear and abrasion.

To address these problems, various methods have been employed over many years but without any significant success. Attention must be paid to use durable and reliable materials for movable components, which are subject to wear and are exposed to the harsh elements. The present invention provides some selected advanced structural ceramic materials which have unexpected advantages in improving the performance and reliability of such snow removal equipment, although it may not be intuitively apparent to many materials specialists. This is because most of the conventional high performance advanced structural ceramics are extremely brittle. An example of a material having high hardness and superior strength (elastic modulus) is monolithic cubic spinel. This material, however, is also highly brittle and is practically unusable for this type of rugged structural applications. Those skilled in the art are more inclined to experiment with alternative metallic components, especially high strength steel or very hard carbide (generally cermets like Ni or Co bonded tungsten carbide).

PROBLEM TO BE SOLVED

Snow plow shoes and snow plow blades are subjected to repeated stress due to plowing at relatively high speeds on paved and unpaved roads and continuous exposure to natural elements like ice, sand or snow, resulting in limited service life for those moving parts. Similar problems are encountered with other types of utility equipment.

A need persists for improved wear protection devices having superior strength and excellent wear, abrasion and corrosion resistance properties while being very reliable and easy to implement. A need persists for improved snow removal equipment equipped with snow plow shoes and blades having superior strength and excellent wear, abrasion and corrosion resistance properties while being very reliable and easy to implement.

SUMMARY OF THE INVENTION

The present invention relates to a wear shoe for use with utility equipment comprising a unitary housing having a top and a bottom surface, wherein the bottom surface engages the ground, and having therein at least one cavity, wherein the at least one cavity passes through the unitary housing from the top surface to the ground-engaging bottom surface, wherein said cavity contains a wear resistant ceramic insert bound within the unitary housing and having a top and a bottom surface, wherein the bottom surface of said wear resistant ceramic insert engages the ground, and a mounting means for attaching the unitary housing to the utility equipment, especially snow removal equipment. The present invention includes a method of attaching wear resistant inserts, preferably ceramic, to a unitary housing by shrink fitting comprising providing at least one wear resistant ceramic insert; providing a unitary housing having at least one cavity passing through the unitary metal housing and made dimensionally smaller than the ceramic insert; heating the unitary housing such that the cavity expands sufficiently to accommodate the ceramic insert; placing the ceramic insert into the heated cavity such that the ceramic insert resides inside the cavity, wherein the ceramic insert is maintained at ambient room temperature; and cooling the unitary housing-ceramic insert assembly to room temperature to shrink the cavity of the unitary housing and attach the ceramic insert rigidly therein. The present invention also relates to a method of attaching wear resistant ceramic inserts to a unitary housing comprising providing at least one wear resistant ceramic insert, providing a unitary housing having at least one cavity passing through the unitary housing and made dimensionally to fit the ceramic insert, placing the ceramic insert into the cavity such that the ceramic insert resides inside the cavity, and attaching the ceramic insert rigidly therein.

ADVANTAGEOUS EFFECT OF THE INVENTION

The present invention includes several advantages, not all of which are incorporated in a single embodiment. The present invention provides an improved and high performance wear shoe for use with utility equipment, most preferably a snow plow or other snow removal equipment, and provides the utility equipment, for example, the snow plow shoes and snow plow blades, with tough ceramic inserts having superior wear, abrasion and corrosion resistance properties. The present invention can also provide wear resistant and corrosion resistant ceramic inserts for the steel or cast iron parts of utility equipment to provide longer service life.

DETAILED DESCRIPTION OF THE INVENTION

Figure 1:
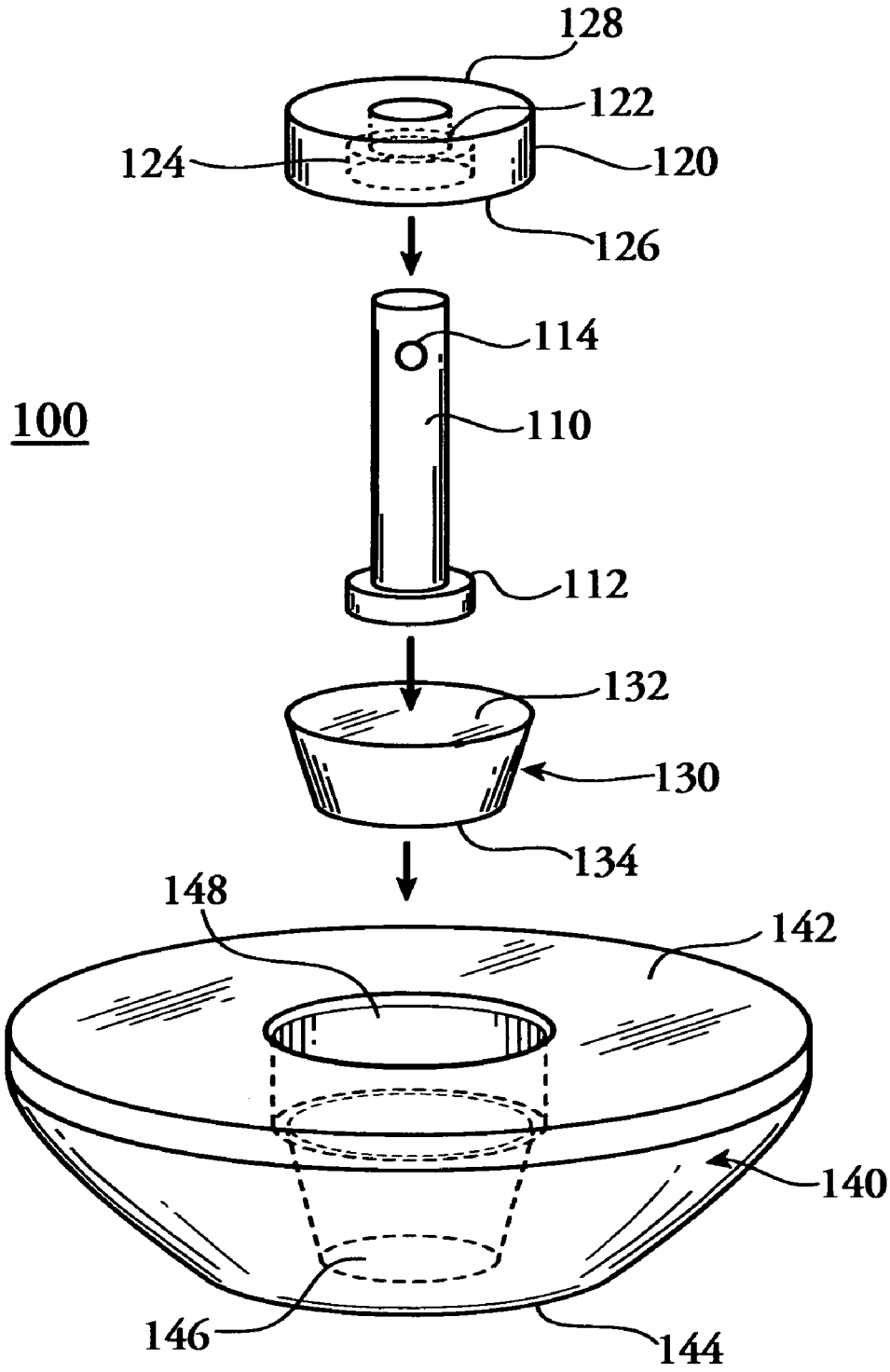
FIG. 1 is an exploded perspective view showing an embodiment of the assembly of a snow plow shoe with a ceramic insert in accordance with the present invention.

Various embodiments of the present invention will be described in details with reference to the drawings, wherein like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention. Although the preferred embodiment of the present invention describes a wear shoe for use with snow plowing and removal equipment, it is understood that the invention includes an improved wear shoe for use with any utility equipment.

The present invention relates to an improved, contacting and sliding surface having remarkably improved wear, abrasion and corrosion resistance, and, therefore, a longer useful and reliable service life.

In one aspect, the present invention provides improved and high performance wear shoes for use with utility equipment comprising a unitary housing having a top and a bottom surface, wherein the bottom surface engages the ground. Most preferably, the unitary housing is a metal housing. The unitary housing has at least one cavity, which passes through the unitary housing from the top surface to the ground-engaging bottom surface. This cavity contains a wear resistant and tough ceramic insert having a top and a bottom surface. The bottom surface of the ceramic insert engages the ground. The unitary housing includes a mounting means for attaching the unitary housing to the snow removal equipment.

In another aspect, the present invention provides a method of attaching the wear resistant ceramic inserts to the unitary housing comprising providing at least one wear resistant ceramic insert, providing a unitary housing having at least one cavity passing through the unitary housing and made dimensionally to fit the ceramic insert at usage temperature, placing the ceramic insert into the cavity such that the ceramic insert resides inside the cavity, and attaching the ceramic insert rigidly therein.

Preferably, the present invention provides a method of attaching the wear resistant ceramic inserts to the unitary housing by shrink fitting. A unitary housing having at least one cavity passing through the unitary housing is provided. At least one wear resistant ceramic insert is also provided. The cavity in the unitary housing is dimensionally smaller than the ceramic insert. The unitary housing is heated such that the cavity expands sufficiently to accommodate the ceramic insert and the ceramic insert is placed into the heated cavity such that the ceramic insert resides inside the cavity. The ceramic insert is maintained at ambient or room temperature during this procedure. The unitary housing-ceramic insert assembly is cooled to room temperature to shrink the cavity of the unitary housing and attach the ceramic insert rigidly therein. Preferably, a unitary metal housing is heated to a temperature above 200° Celsius and preferably below 600° Celsius in a temperature controlled furnace. The fit of the ceramic insert in the cavity can also be additionally strengthened, for example, by the use of adhesives or a brazing alloy.

FIG. 1 is an exploded perspective view of a snow plow shoe assembly 100 for use in light duty trucks, depicting how the metal and ceramic components are assembled as a hybrid unit in a unitary metal housing 140. A mounting rod 110 has a ledge 112 on one end for attaching rigidly to a metal disc 120 and a through hole 114 on the other end for the purpose of mounting to the snow plowing equipment (not shown). The metal disc 120 comprises a top surface 128 and a bottom surface 126, wherein the bottom surface 126 is in contact with a ceramic insert 130. The mounting rod 110 can be attached rigidly to the metal disc 120 by one of numerous ways, including interference fitting or heat shrinking, welding, brazing or mechanical fastening using threads. In FIG. 1, the mounting rod 110 is attached to the metal disc 120 by heat shrinking, also known as interference fitting, by inserting the mounting rod 110 through a plurality of concentric and open ended disc cavities 122 and 124 provided in the disc 120 and maintained at the ambient temperature so that the ledge 112 provided at one end of the mounting rod 110 rests inside the disc cavity 124 being parallel to the bottom surface 126 of the disc. The disc cavities 122, 124 are dimensionally smaller than the mounting rod 110 and the ledge 112 at ambient temperatures and are designed to accommodate the mounting rod 110 and the ledge 112 when the disc is heated. For example, the diameters of the disc cavities 122 and 124 can be preferably kept approximately 0.005 to 0.020 inch smaller than those of the mounting rod and the ledge, so that, after cooling to room temperature, an interference shrink fit is accomplished, thereby providing a strong bond between the disc 120 and the mounting rod 110.

The housing preferably made from steel or iron, especially rolled steel, cast steel and cast iron, may have virtually any shape or any size depending upon application. Other representative structural metals can include steel, aluminum, titanium or combinations thereof. Generally, the housing includes a single or plurality of cavities for accommodating a single or plurality of ceramic inserts. In FIG. 1, the metal housing 140 comprises a top surface 142 and a ground-engaging bottom surface 144. Unitary metal housing 140 contains a cavity 146 designed to accommodate the ceramic insert 130. The metal housing 140 is designed such that two open ended concentric cavities 146 and 148 are provided for placing the ceramic insert 130 and the disc 120, wherein the disc 120 is fixedly bonded to the mounting rod 110.

A preferred embodiment of the present invention, the ceramic insert 130 is designed to have a conical shape and comprises a top surface 132 having a larger surface area than a ground-engaging bottom surface 134, which is oriented parallel to the bottom surface 144 of the metal housing 140. The conical shape helps retain the ceramic insert 130 inside the cavity 146 of the metal housing 140 because the probability of dislodging the ceramic insert 130 from the metal housing 140 is less as the bottom surface 144 and the cavity 146 start wearing out in course of time due to abrasion, wear, and corrosion. The ceramic insert 130, having the bottom surface 134 engaging the ground and the top surface 132 in contact with the bottom surface 126 of the disc 120, is placed inside the unitary metal housing 140 to contact the ground and extend the service life of the snow plow shoe.

The ceramic insert can be made from oxide, carbide, boride, and nitride ceramics or combinations thereof. The oxide ceramic materials are, most preferably, selected from the group consisting of zirconia, alumina, magnesia, titania, silica, hafnia, scandia, yttria, ceria and combinations thereof. The carbide ceramics are most preferably selected from the group consisting of silicon carbide, titanium carbide, tungsten carbide, boron carbide and combinations thereof. The nitride ceramics are most preferably selected from the group consisting of silicon nitride, titanium nitride, aluminum nitride, boron nitride, zirconium nitride, and combinations thereof. The present invention preferably uses the novel ceramic materials described by Ghosh et al in U.S. Pat. Nos. 5,336,282; 5,520,601; and 5,411,690, incorporated herein by reference in their entirety.

The ceramic insert can be made from tough, wear and corrosion resistant oxide ceramics such as 3 to 5 mole % yttria alloyed zirconia, alumina toughened zirconia and zirconia toughened alumina. Materials like silicon carbide or composites like zirconia reinforced alumina, or silicon carbide reinforced alumina may also be used for this application. Other useful alloys can include $ZrO_2$ and an additional oxide or combination of oxides selected from: MgO, CaO, $Y_2O_3$, $Sc_2O_3$, $Ce_2O_3$ and other rare earth oxides. The preparation of zirconia alloys is well known to those skilled in the art and zirconia alloys are available commercially. For example, particulate zirconia alloy having 3 mole percent $Y_2O_3$ is marketed by Tosoh Corporation of Japan, as TZ-3YB, 3 mole % Yttria Stabilized Zirconia".

Useful zirconia alloys can include the monoclinic, cubic and tetragonal crystallographic phases. Useful zirconia alloys can have a metastable tetragonal crystal structure in the temperature and pressure ranges at which the ceramic article produced will be used. For example, zirconium oxide and yttria in a molar ratio of yttria to zirconium oxide of from about 3:97 to about 5:95 in which the ceramic consists essentially of a tetragonal crystal phase grain can be used. In alternative embodiments, the outer surface of the ceramic can be modified to comprise the cubic phase crystal grain or the monoclinic phase crystal grain.

Most preferably, this invention utilizes tetragonal $ZrO_2$, made from a chemical mixture of pure $ZrO_2$ doped with an additional "secondary oxide" selected from MgO, CaO, $Y_2O_3$, $Sc_2O_3$ and $CeO_2$ and other rare earth oxides. Specific examples of doped zirconia alloys include: tetragonal structure zirconia having from about 0.5 to about 5 mole % $Y_2O_3$. In the case of MgO, 0.1 to 1.0 mole % provides tetragonal structure, and for $CeO_2$, 0.5 to 15 mole % provides tetragonal structure and $Sc_2O_3$ at about 0.5 mole to 7.0 mole % produces tetragonal structure, and in the case of CaO from about 0.5 to about 5 mole % produces tetragonal structure. Examples of tetragonal structure zirconia alloys are disclosed in U.S. Pat. Nos. 5,290,332 and 5,411,690, both incorporated herein by reference. Ceramic matrix composites wherein tetragonal zirconia is alloyed with other particulate ceramics such as 5 to 20% by weight $Al_2O_3$ to form a tough composite may also be utilized. This is commercially known as alumina toughened zirconia.

The ceramic insert is held strongly in the cavity of the housing. This may be accomplished by a variety of techniques, such as welding, brazing, adhesives, or, most preferably, shrink-fitting (also referred to as interference fitting).

Since the snow plow shoes ride over rough surfaces including many potholes, it is very important that the selected material for ceramic inserts must have reasonably good impact resistance property along with wear, abrasion and corrosion resistance properties. High fracture toughness, good wear and abrasion resistance and excellent corrosion resistance properties are some of the requirements in selecting the ceramic composition for the ceramic insert 130.

Figure 2:
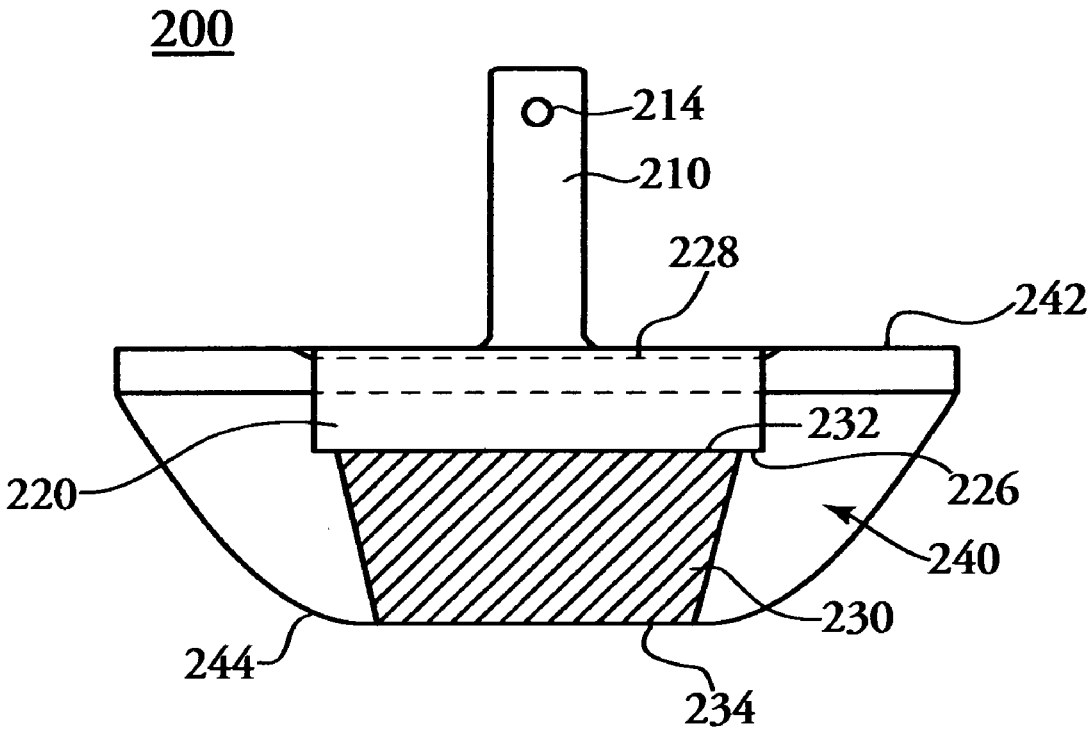
FIG. 2 is a cross-sectional view of an assembled snow plow shoe with ceramic inserts.

FIG. 2 represents a cross-sectional view of a preferred assembled and vehicle-mountable metal-ceramic hybrid snow plow shoe 200. The unitary metal housing 240 has a top surface 242 and a ground engaging bottom surface 244. A ceramic insert 230 is held strongly in the cavity of the metal housing 240 as a result of the interference fitting by the heat shrinking process. The ceramic insert 230 is designed to have a conical shape and comprises a top surface 232 having a larger surface area than a ground-engaging bottom surface 234, which is oriented parallel to the bottom surface 244 of the metal housing 240. A mounting rod 210 has a ledge on one end for attaching rigidly to a metal disc 220 and a through hole 214 on the other end for the purpose of mounting to the snow plowing equipment (not shown). The metal disc 220 comprises a top surface 228 and a bottom surface 226, wherein the bottom surface 226 is in contact with a ceramic insert 230.

Figure 3:
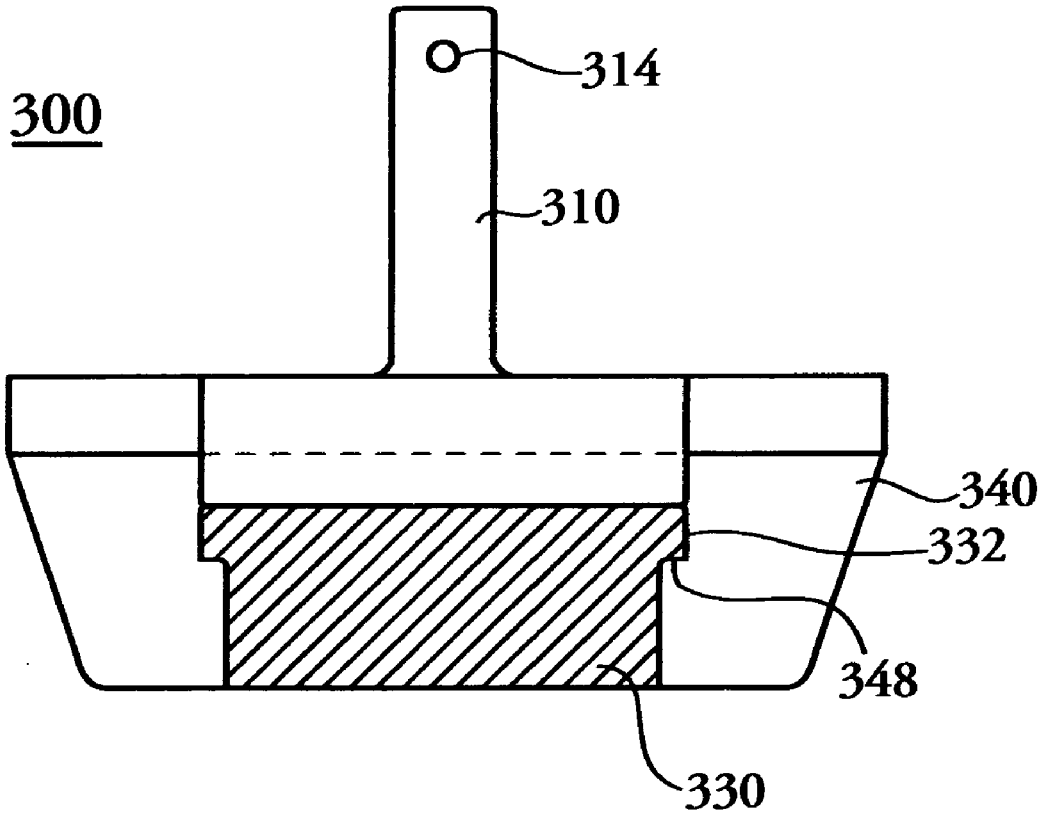
FIG. 3 is a cross-sectional view of another preferred embodiment of the invention showing a ceramic insert embedded in a metal housing.

FIG. 3 represents a cross-sectional view of another preferred assembled and truck-mountable metal-ceramic hybrid snow plow shoe 300. The ceramic insert 330 having a cylindrical shape comprising a ledge 332 which rests on a recess 348 inside the cavity of a unitary metal housing 340. The ceramic insert 330 is designed such that the ledge 332 acts as an anchor against untimely dislodging of the ceramic insert 330 as the unitary metal housing 340 wears out due to abrasion and corrosion. A mounting rod 310 comprising a hole 314 for mounting to a snow plow, is bonded to the unitary metal housing 340 by shrink fitting or welding.

To form the vehicle-mountable assembly via heat-shrinking or interference fitting, a metal housing is heated to a temperature higher than 200° Celsius but not exceeding 600° Celsius, placing first a ceramic insert inside the cavity followed by placing a disc, wherein the disc has been bonded to a mounting rod. In the preferred embodiment, the mounting rod is also attached to the metal disc by heat shrinking, also known as interference fitting. This is accomplished by heating the disc to a temperature above 200° Celsius and preferably below 600° Celsius, inserting the mounting rod through a plurality of concentric and open ended cavities provided in the disc and maintained at the ambient temperature so that the ledge provided at one end of the mounting rod rests inside the disc cavity being parallel to the bottom surface of the disc.

A conventional oven using electrical resistance heating or gas heating can be used for the heating process. The preferred and more cost effective method of heating is using an induction heating furnace, wherein the heating cycle can be reduced by over 90% and the energy consumption by about 80%. The disc is allowed to cool to room temperature. After cooling to room temperature, an interference shrink fit is accomplished, thereby providing a strong bond between the disc and the mounting rod.

EXAMPLES

In the working examples, snow plow shoes with ceramic inserts were mounted in pick up trucks which were equipped with snow plows and were used plowing snow on paved and unpaved roads. The performance of the improved snow plow shoes with ceramic inserts was far superior to conventional snow plow shoes.

A pair of ceramic-metal hybrid wear shoes, each comprising a single ceramic insert, were constructed by machining steel to form the unitary metal housing, disc and the mounting rod as described in FIG. 2. Conical ceramic inserts were made using alumina toughened zirconia (20% alumina mixed with 3 mole % yttria stabilized zirconia) and bonded to the metal housing by a heat shrinking process.

The metal discs were bonded to the mounting rods by heat shrinking process. The cavities in the metal discs were machined about 0.005 inches smaller than the diameters of the mounting rods. The metal discs were placed inside a conventional electric resistance furnace, wherein the temperature was ramped up to 300° C. at 10° C. per minute, were allowed to soak at 300° C. for at least 30 minutes in order to make sure that the metal discs are uniformly heated and the cavities had expanded enough to accommodate the mounting rod. The heated metal discs were removed from the furnace followed by inserting the mounting rods being held at room temperature, through the cavities and allowed to cool to room temperature so that the metal discs shrink around the mounting rod to form a rigid bond.

Next, a pair of unitary metal housings comprising two concentric and open ended cavities to accommodate the conical shaped ceramic insert and the metal disc bonded to the mounting rod respectively were heated to 300° C. as described hereinbefore. In this example, a conical shaped ceramic insert having the following dimension was used:

Top diameter: 2.500 inch

Bottom diameter: 2.200 inch

Thickness: 0.625 inch

The top diameter of the ceramic insert was precisely 0.007 inch larger than the top diameter (2.493 inch) of the cavity in the metal housing, and similarly, the bottom diameter of the ceramic insert was 0.007 inch larger than the bottom diameter (2.1930 inch) of the open-ended cavity in the metal housing. The heated metal housings were taken out of the furnace and placed on a thermally insulating alumina slab and the ceramic inserts, being held at room temperature, were placed inside the cavities followed by the metal discs that were attached to mounting rods. The assemblies were allowed to cool to room temperature. The cavities in the metal housings shrunk around the ceramic inserts and the metal discs to form ceramic-metal hybrid wear shoes. These ceramic-metal hybrid wear shoes were placed in service plowing paved and unpaved country roads. The ceramic-metal hybrid wear shoes lasted 12 times longer than the conventional metal wear shoes.

The invention has been described in detail with particular reference to certain preferred embodiments thereof, but it will be understood that variations and modifications can be effected within the spirit and scope of the invention.

What is claimed is:

1. A wear shoe for use with utility equipment comprising a unitary housing having a top and a bottom surface, wherein the bottom surface engages the ground, and having therein at least one cavity, wherein the at least one cavity passes through the unitary housing from the top surface to the ground-engaging bottom surface, wherein said cavity contains a wear resistant ceramic insert bound within the unitary housing and having a top and a bottom surface, wherein the bottom surface of said wear resistant ceramic insert engages the ground, and a mounting means for attaching the unitary housing to the utility equipment, wherein said wear resistant ceramic insert comprises zirconium oxide.

2. The wear shoe of claim 1, wherein said wear resistant ceramic insert comprises a tetragonal zirconia alloy comprising 3 to 5 mole % yttria.

3. The wear shoe of claim 1, wherein the zirconium oxide further comprises ceramic materials selected from the group consisting of alumina, magnesia, titania, silica, hafnia, scandia, yttria, ceria and combinations thereof.

4. The wear shoe of claim 1, wherein said oxide ceramic materials comprise zirconia doped with yttria or alloyed with alumina.

5. The wear shoe of claim 1, wherein said wear resistant ceramic insert comprises a tetragonal zirconia alloy.

6. The wear shoe of claim 1 wherein the unitary housing is made from a structural metal selected from the group consisting of steel, iron, aluminum, titanium or combinations thereof.

7. The wear shoe of claim 1, wherein said unitary housing is made from steel.

8. The wear shoe of claim 1 wherein the wear resistant ceramic insert is bound within the unitary housing by shrink fitting.

9. The wear shoe of claim 1 wherein the wear resistant ceramic insert is bound within the unitary housing by a brazing alloy.

10. The wear shoe of claim 1 wherein the wear resistant ceramic insert is bound within the unitary housing by adhesives.

11. The wear shoe of claim 1 wherein said utility equipment comprises snow removal equipment.

12. A method of attaching wear resistant inserts to a unitary housing by shrink fitting comprising:

a. providing at least one wear resistant insert;

b. providing a unitary housing having at least one cavity passing through the unitary metal housing and made dimensionally smaller than the insert;

c. heating the unitary housing such that the cavity expands sufficiently to accommodate the insert;

d. placing the insert into the heated cavity such that the insert resides inside the cavity, wherein the insert is maintained at ambient room temperature; and e. cooling the unitary housing-insert assembly to room temperature to shrink the cavity of the unitary housing and attach the insert rigidly therein;

wherein said wear resistant insert comprises a zirconium oxide ceramic doped with yttria or alloyed with alumina.

13. The method of claim 12 wherein the unitary housing is a unitary metal housing.

14. The method of claim 13 wherein heating the unitary housing comprises heating to a temperature above 200'Celsius and below 600'Celsius.

15. The method of claim 12 wherein the unitary housing is heated in a temperature controlled furnace.

16. A wear shoe for use with utility equipment comprising a unitary housing having a top and a bottom surface, wherein the bottom surface engages the ground, and having therein at least one cavity, wherein the at least one cavity passes through the unitary housing from the top surface to the ground-engaging bottom surface, wherein said cavity contains a wear resistant ceramic insert bound within the unitary housing and having a top and a bottom surface, wherein the bottom surface of said wear resistant ceramic insert engages the ground, and a mounting means for attaching the unitary housing to the utility equipment, wherein said wear resistant ceramic insert comprises zirconium oxide doped with or alloyed with alumina.

* * * * *